United States Patent [19]

Baldwin et al.

[11] 4,164,466

[45] Aug. 14, 1979

[54] METHOD OF IMPROVING YIELD IN A COAL LIQUEFACTION PRODUCT DEASHING PROCESS

[75] Inventors: Roger A. Baldwin, Warr Acres; Robert E. Davis, Oklahoma City; Robert E. Leonard, Oklahoma City; Donald E. Rhodes, Oklahoma City, all of Okla.

[73] Assignee: Kerr-McGee Corporation, Oklahoma City, Okla.

[21] Appl. No.: 888,284

[22] Filed: Mar. 20, 1978

[51] Int. Cl.[2] ..... C10G 1/04; C10G 29/20

[52] U.S. Cl. ..... 208/177; 208/8 LE

[58] Field of Search ..... 208/8, 251 R, 177, 8 LE

[56] References Cited

U.S. PATENT DOCUMENTS

| | | | |
|---|---|---|---|
| 2,793,167 | 5/1957 | Webber | 208/251 R |
| 3,507,777 | 4/1970 | Hemminger | 208/251 R |
| 3,607,716 | 9/1971 | Roach | 208/8 |

*Primary Examiner*—Herbert Levine

*Attorney, Agent, or Firm*—William G. Addison

[57] ABSTRACT

A coal deashing process wherein a feed mixture comprising soluble coal products, insoluble coal products and solvent is separated in a first separation zone into a first heavy phase and a first light phase comprising soluble coal products, solvent and some insoluble coal products. The first light phase is withdrawn and introduced into a second separation zone wherein it separates into a second heavy phase comprising insoluble coal products, soluble coal products and some solvent and a second light phase comprising soluble coal products and solvent. The second heavy phase is withdrawn and at least a portion is recycled to the first separation zone to increase the yield of separable soluble coal products ultimately recovered by the process. In alternate embodiments, additional solvent can be added to the first light phase before introduction into the second separation zone or the recycled portion of the second heavy phase may be introduced into a treatment zone before reintroduction into the first separation zone. The treatment zone effects an increase in the molecular weight of at least a portion of the recycled second heavy phase which facilitates subsequent separation in the first separation zone.

20 Claims, 4 Drawing Figures

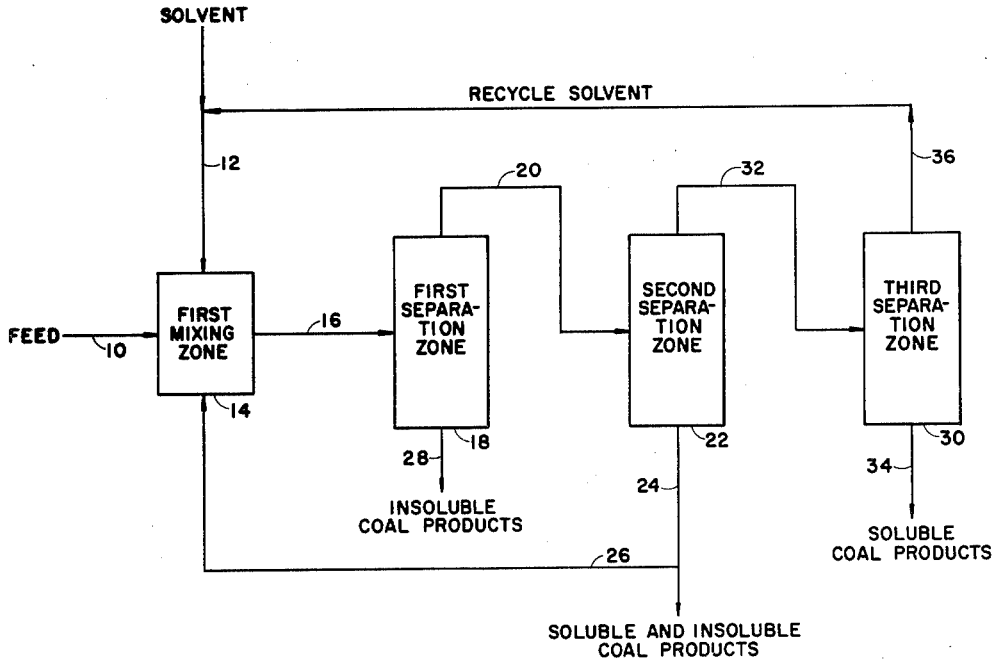

METHOD OF IMPROVING YIELD IN A COAL LIQUEFACTION PRODUCT DEASHING PROCESS

BACKGROUND OF THE INVENTION

1. Field of the Invention

The present invention relates generally to coal liquefaction product deashing processes and, more particularly but not by way of limitation to improved separation techniques in coal liquefaction product deashing processes.

2. Description of the Prior Art

Various coal liquefaction processes have been developed in the past wherein coal has been treated with one or more solvents and processed to separate the resulting insoluble coal products from the soluble coal products.

U.S. Pat. No. 3,607,716 and U.S. Pat. No. 3,607,717 issued to Roach and assigned to the same assignee as the present invention, disclose processes wherein coal is contacted with a solvent and the resulting mixture then is separated into a heavy phase containing the insoluble coal products and a light phase containing the soluble coal products. Other processes for separating the soluble coal products from the insoluble coal products present in coal liquefaction products utilizing one or more solvents are disclosed In U.S. Pat. Nos. 3,607,718 and 3,642,608, both issued to Roach et al., and assigned to the same assignee as the present invention.

While those processes provide a means for substantially separating the soluble coal products from the insoluble coal products, some soluble coal products still are separated with the insoluble materials in the heavy phase. It would be desirable to increase the mineral matter content of the insoluble coal products comprising the heavy phase to reduce the loss of valuable soluble coal products also contained therein.

SUMMARY OF THE INVENTION

The surprising discovery now has been made that the mineral matter content of the insoluble coal products in the first heavy phase separated from the first lighter phase containing soluble and insoluble coal products can be increased by separations effected in a second sequential separation zone. More specifically, in one embodiment, coal liquefaction products comprising soluble coal products and insoluble coal products are contacted with a solvent and introduced into a first separation zone maintained at an elevated temperature and pressure determined to maximize the yield of soluble coal products ultimately recovered.

In the first separation zone, the coal liquefaction products separate into a first heavy phase comprising insoluble coal products and a first light phase comprising soluble and some insoluble coal products. The first light phase is withdrawn and introduced into a second separation zone maintained at an elevated temperature and a pressure level substantially no greater than the pressure level in the first separation zone to cause the first light phase to separate into a second heavy phase comprising soluble coal products and insoluble coal products and a second light phase comprising soluble coal products. The second heavy phase is withdrawn and at least a portion thereof is returned to mix with the feed mixture entering the first separation zone. The recycle of the second heavy phase effects an increase in the yield of soluble coal products ultimately recovered by the process. The second light phase is withdrawn and introduced into a third separation zone maintained at an elevated temperature and a pressure substantially no greater than the pressure level in the second separation zone to cause the second light phase to separate into a third light phase comprising solvent and a third heavy phase comprising soluble coal products.

In another embodiment, the withdrawn first light phase described hereinabove is contacted with additional solvent before introduction into the second separation zone. The first light phase then is separated as previously described.

In yet another embodiment, the second heavy phase produced by either of the procedures set forth hereinabove is withdrawn from the second separation zone and at least a portion thereof is introduced into a treatment zone. The treatment zone can comprise a temperature treatment resulting in partial polymerization of the material present or an oxidation treatment resulting in oxydehydrogenation or in incorporation of oxygen into the material to thereby increase the molecular weight of some of the treated second heavy phase. The treated material then is introduced into the feed to the first separation zone for separation of the insoluble coal products. This separation provides an increase in the yield of soluble coal products recovered as a subsequent heavy phase.

The enhanced separation of the present invention produces soluble coal products in an increased yield to thereby provide a more economical coal deashing process.

DESCRIPTION OF THE PREFERRED EMBODIMENT

Figure 1:
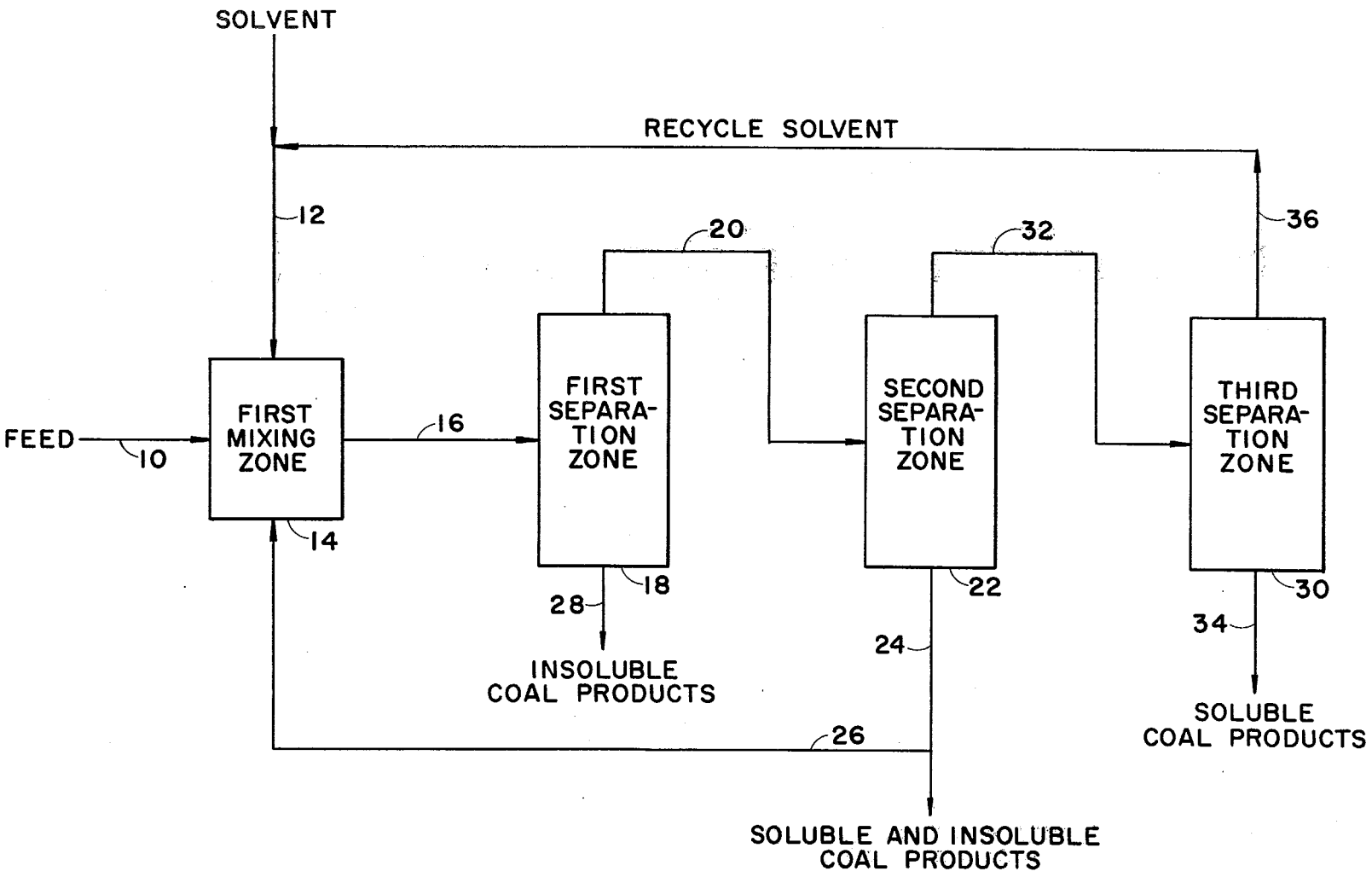
FIG. 1 is a diagrammatic illustration of one embodiment of the present invention.

Turning now to FIG. 1, a feed comprising hydrocarbonaceous material is introduced into a first mixing zone 14 through a conduit 10. The hydrocarbonaceous material comprises coal liquefaction products or fractions thereof containing soluble coal products and insoluble coal products produced by any process for the liquefaction of coal or other carbonaceous materials.

In the first mixing zone 14, the feed is contacted by and mixed with a solvent introduced through a conduit 12 to provide a feed mixture. Sufficient solvent is introduced into the mixing zone 14 to provide a ratio by weight of solvent to feed in the feed mixture of from about 1:1 to about 10:1. It is to be understood that larger quantities of solvent can be employed, however such use is uneconomical. The feed mixture is discharged from the first mixing zone 14 through a conduit 16 to enter a first separation zone 18, comprising for example a separating vessel.

The first separation zone 18 is maintained at an elevated temperature and pressure to effect a separation of the feed mixture into a first heavy phase comprising insoluble coal products and some solvent and a first light phase comprising soluble coal products, some insoluble coal products and solvent.

The first separation zone 18 is maintained at a temperature level in the range of from about 400 degrees F. to about 700 degrees F. The pressure level is maintained in the range of from about 600 psig to about 1500 psig.

The particular temperature and pressure conditions are selected to maximize the mineral matter content of the first heavy phase. Selection of such conditions maximizes the yield of recoverable soluble coal products in the first light phase; however, such conditions also result in the presence of insoluble coal products in the first light phase.

The first light phase is withdrawn from the first separation zone 18 through a conduit 20 and introduced into a second separation zone 22, comprising for example a second separating vessel. The second separation zone 22 is maintained at a temperature level higher than the temperature level in the first separation zone 18 and a pressure level substantially the same or below the pressure level in the first separation zone 18 to effect a separation of the first light phase therein. Preferably, the temperature level in the second separation zone is maintained in the range of from about 410 degrees F. to about 750 degrees F. and the pressure level is maintained in the range of from about 590 psig to about 1500 psig.

The particular temperature and pressure conditions in the second separation zone 22 are selected to provide a differential in the solvent density in the first light phase sufficiently large to cause the first light phase to separate into two fluid-like phases. The first light phase separates into a second heavy phase comprising insoluble coal products, soluble coal products and some solvent and a second light phase comprising soluble coal products and solvent.

The second heavy phase is withdrawn from the second separation zone through a conduit 24. At least a portion of the second heavy phase flowing in conduit 24 is withdrawn in a conduit 26 and introduced into the mixing zone 14 to contact and mix with entering feed and solvent. The feed mixture which now includes the recycled portion of the second heavy phase then is introduced into the first separation zone 18 through conduit 16 to separate as described hereinbefore.

The remaining portion of the second heavy phase in conduit 24, if any, may be introduced into subsequent processing equipment (not shown) to recover hydrocarbon values. Such processing equipment may include, for example, gasifiers or cokers.

Alternatively, the remaining portion of the second heavy phase, if any, may be introduced into a flash zone (not shown) to effect a recovery of any solvent which may be volatilized thereby. The recovered solvent is recycled to the first mixing zone 14 to aid in providing the feed mixture.

It has been found that when at least a portion of the second heavy phase is recycled to the first separation zone the yield of low ash content soluble coal products subsequently recovered from the feed increases.

The first heavy phase is withdrawn from the first separation zone 18 through a conduit 28. The first heavy phase can be flashed (not shown) upon withdrawal from the first separation zone 18 to effect a recovery of any solvent which may be volatilized thereby. The flashed first heavy phase then can be introduced into subsequent processing equipment (not shown) and the solvent can be returned to the first mixing zone 14.

The second light phase comprising soluble coal products and solvent is withdrawn from the second separation zone 22 and introduced into a third separation zone 30, comprising for example a third separation vessel, through a conduit 32.

The third separation zone 30 is maintained at a temperature level higher than the temperature level maintained in the second separation zone 22 and a pressure level substantially no greater than the pressure level in the second separation zone 22. Preferably, the temperature level is maintained in the range of from about 500 degrees F. to about 950 degrees F. and the pressure level is maintained in the range of from about 40 psig to about 1450 psig to effect a separation of the second light phase into a third heavy phase comprising soluble coal products and a third light phase comprising solvent.

The particular temperature and pressure conditions in the third separation zone 30 are selected to effect the maximum separation of the soluble coal products by providing a differential in the solvent density in the second light phase sufficiently large to cause the second light phase to separate into the two fluid-like phases.

The third heavy phase is withdrawn from the third separation zone 30 through a conduit 34. The third heavy phase may be flashed (not shown) upon withdrawal to separate and recover any solvent which remains in the third heavy phase and that can be volatilized thereby.

Alternatively, the second light fraction can be separated in the third separation zone into a third heavy phase comprising heavy soluble coal product fractions and a third light phase comprising solvent and lighter soluble coal product fractions. The light phase then is withdrawn and introduced into subsequent additional separation zones to separate the lighter soluble coal product fractions into a multiplicity of separate fractions and a final light phase comprising solvent for recycle to the first mixing zone 14 to aid in providing additional feed mixture.

In the process generally described above the term "solvent" is intended to mean those fluids which are sometimes described as "light organic solvents", for example, in U.S. Pat. Nos. 3,607,716, 3,607,717, 3,607,718 and 3,642,608 the disclosures of which are incorporated herein by reference. More specifically, the solvent consists essentially of at least one substance having a critical temperature below 800 degrees F. selected from the group consisting of aromatic hydrocarbons having a single benzene nucleus and normal boiling points below about 310 degrees F., cycloparaffin hydrocarbons having normal boiling points below about 310 degrees F., open chain mono-olefin hydrocarbons having normal boiling points below about 310 degrees F., open chain saturated hydrocarbons having normal boiling points below about 310 degrees F., mono-, di- and tri-open chain amines containing from about 2–8 carbon atoms, carbocyclic amines having a monocyclic structure containing from about 6–9 carbon atoms, heterocyclic amines containing from about 5–9 carbon atoms, and phenols containing from about 6–9 carbon atoms and their homologs.

The term "insoluble coal products" means undissolved coal, mineral matter, other solid inorganic particulate matter and other such matter which is insoluble in the solvent under the conditions of this invention.

The term "soluble coal products" means the constituents of the feed that are soluble in the solvent under the conditions of this invention.

Figure 2:
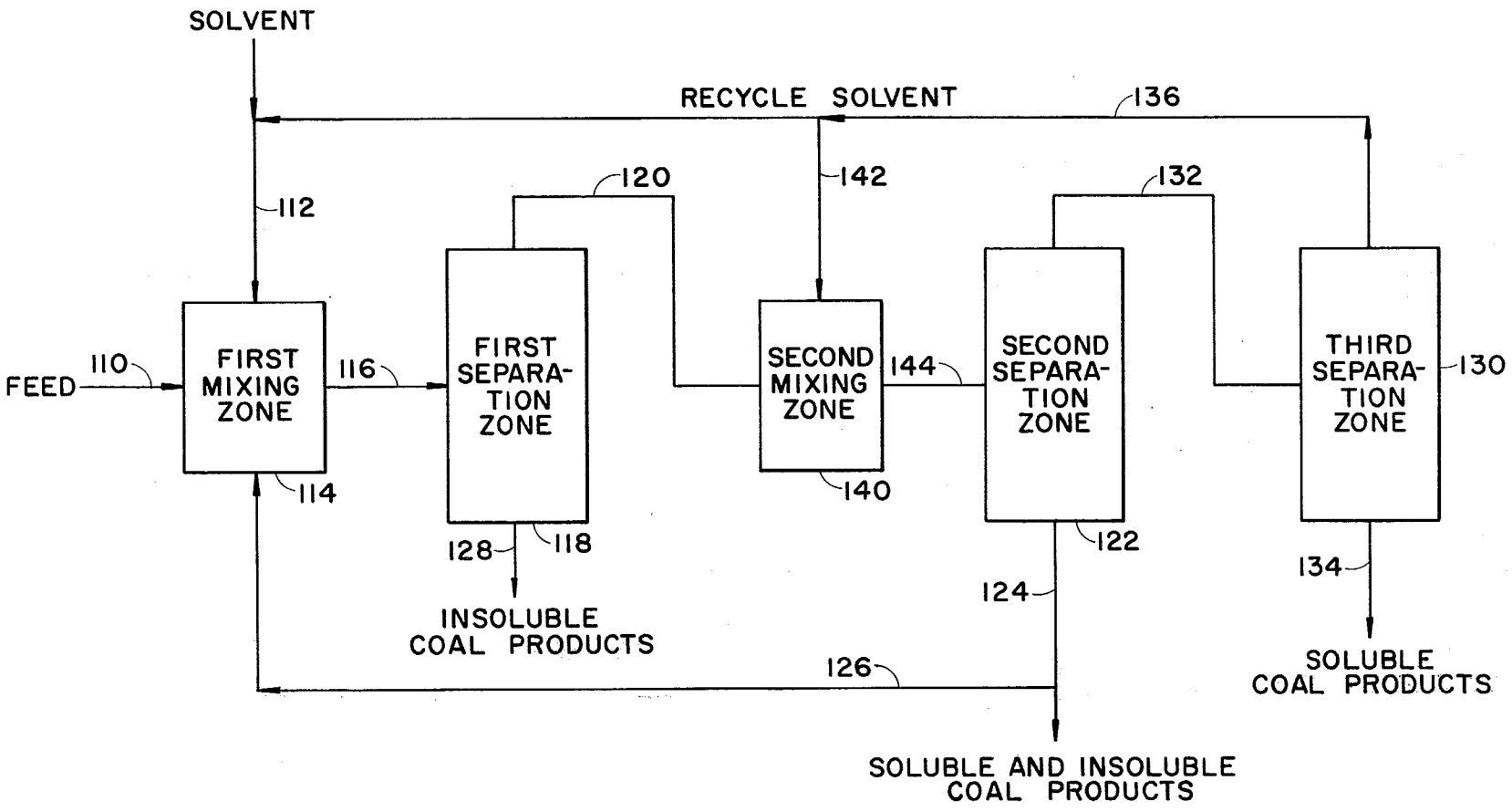
FIG. 2 is a diagrammatic illustration of another embodiment of the present invention incorporating staged solvent addition.

Turning now to FIG. 2, an alternate embodiment of the present invention is illustrated. In this embodiment, the feed enters a first mixing zone 114 through a conduit 110. In the first mixing zone 114, the feed is contacted and mixed with a solvent entering via a conduit 112 to provide a "feed mixture." In this embodiment, the ratio of solvent is feed present in the feed mixture is from about 1:1 to below about 2:1, by weight. The feed mixture is discharged from the first mixing zone through a conduit 116 to enter a first separation zone 118.

The first separation zone 118 is maintained at a temperature level in the range of from about 400 degrees F. to about 700 degrees F. and a pressure level in the range of from about 600 psig to about 1500 psig to effect a separation of the feed mixture to maximize the yield of recoverable soluble coal products.

In the first separation zone 118, the feed mixture separates into a first heavy phase and a first light phase comprising soluble coal products, solvent and insoluble coal products. The low ratio of solvent to feed used in the feed mixture has been found to increase the quantity of soluble coal products ultimately recovered. However, it is substantially more difficult to effect a separation of the feed mixture into two fluid-like phases to yield a light phase substantially free of mineral matter through control of the temperature conditions within the first separation zone 118.

The first light phase is withdrawn from the first separation zone 118 and introduced into a second mixing zone 140 by a conduit 120. In the second mixing zone 140 the first light phase is contacted and mixed with additional solvent entering via a conduit 142. Sufficient additional solvent is mixed with the first light phase to provide a ratio of solvent to feed of from about 2:1 to about 10:1, by weight. The mixture then is discharged through a conduit 144 to enter a second separation zone 122.

The second separation zone 122 is maintained at a temperature level higher than the temperature level maintained in the first separation zone 118 and a pressure level substantially the same or below the pressure level in the first separation zone to effect a separation of the mixture therein. Preferably, the temperature level in the second separation zone is maintained in the range of from about 410 degrees F. to about 750 degrees F. and the pressure level is maintained in the range of from about 590 psig to about 1500 psig.

The particular temperature and pressure conditions in the second separation zone 122 are selected to provide a differential in the solvent density in the first light phase sufficiently large to cause the first light phase to separate into two fluid-like phases.

The mixture separates into a second heavy phase comprising the insoluble coal products, some soluble coal products and some solvent and a second light phase comprising soluble coal products and solvent.

The second heavy phase is withdrawn from the second separation zone 122 through a conduit 124. At least a portion of the second heavy phase flowing in conduit 124 is withdrawn in a conduit 126 for return and reintroduction into the first mixing zone 114 to mix with entering feed mixture. The recycled portion of the second heavy phase is discharged from the first mixing zone 114 with the feed mixture through conduit 116 into the first separation zone 118 to separate the soluble coal products contained therein.

The first heavy phase is withdrawn from the first separation zone 118 through a conduit 128.

The second light phase is withdrawn from the second separation zone 122 through a conduit 132 and introduced into a third separation zone 130.

The third separation zone 130 is maintained at a temperature level higher than the temperature level maintained in the second separation zone 122 and a pressure level substantially no greater than the pressure level of the second separation zone 122 to effect a separation of the second light phase into a third heavy phase and a third light phase. Preferably, the temperature level is maintained in the range of from about 500 degrees F. to about 950 degrees F. and the pressure level is maintained in the range of from about 40 psig to about 1450 psig.

The particular temperature and pressure conditions in the third separation zone 130 are selected to effect the maximum separation of the soluble coal products by providing a differential in the solvent density in the second light phase sufficiently large to cause the second light phase to separate into the two fluid-like phases.

The third light phase comprising solvent is withdrawn from the third separation zone 130 through a conduit 136 for recycle to the first mixing zone 114 and the second mixing zone 140 by connection to conduits 112 and 142 respectively, the third heavy phase comprising soluble coal products is withdrawn from the third separation zone through a conduit 134.

Figure 3:
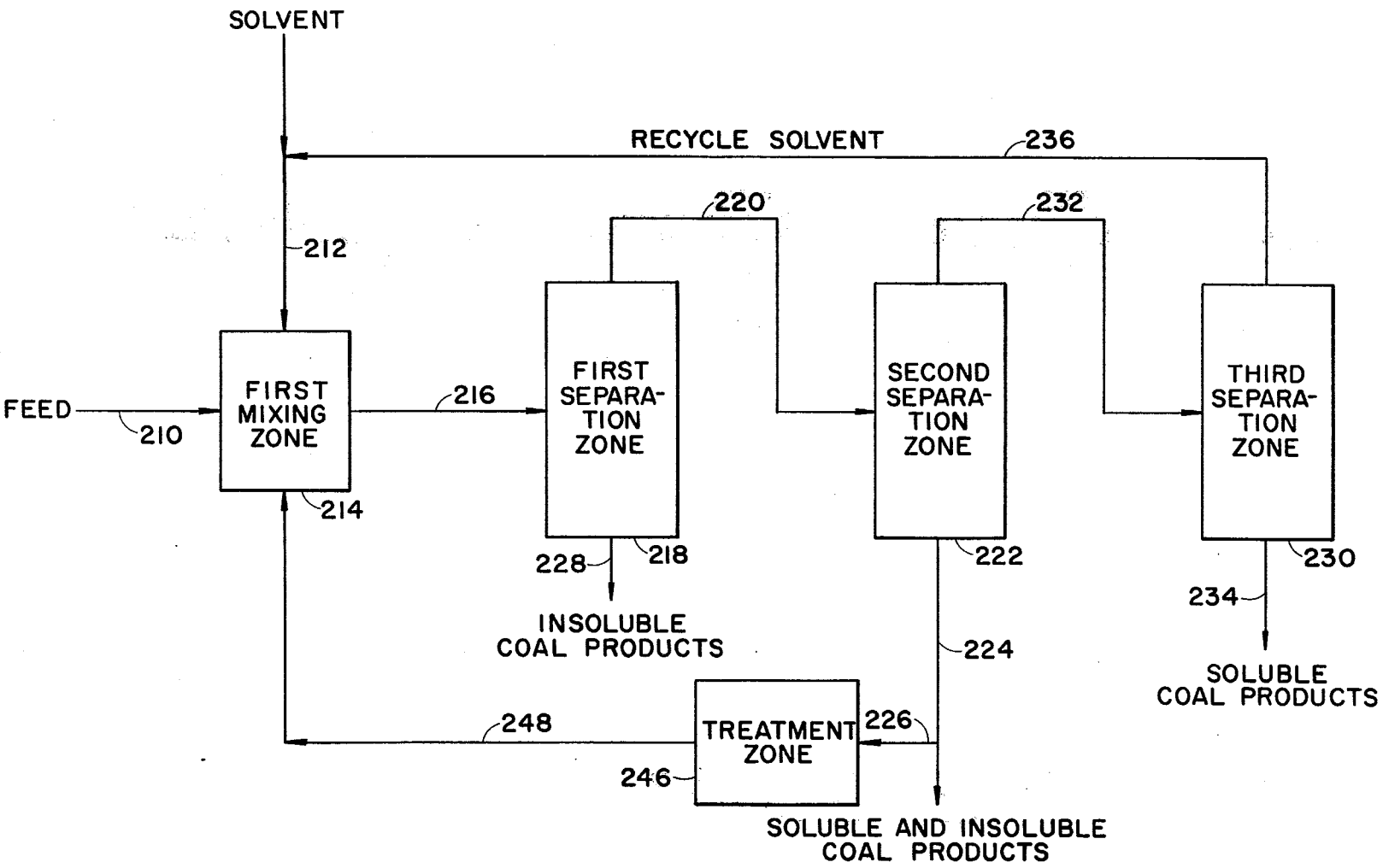
FIG. 3 is a diagrammatic illustration of the process of FIG. 1 incorporating a treatment zone in the second heavy phase recycle conduit.

Turning now to FIG. 3, yet another embodiment of the present invention is illustrated. A feed flowing in a conduit 210 enters a first mixing zone 214 and is contacted and mixed with a solvent introduced into the first mixing zone 214 through a conduit 212 to provide a feed mixture. The feed mixture is discharged from the first mixing zone 214 through a conduit 216 to enter a first separation zone 218.

The first separation zone 218 is maintained at a temperature level in the range of from about 400 degrees F. to about 700 degrees F. and a pressure level in the range of from about 600 psig to about 1500 psig to effect a separation of the feed mixture into a first heavy phase and a first light phase comprising soluble coal products, solvent and some insoluble coal products. The first light phase is withdrawn from the first separation zone 218 through a conduit 220 and introduced into a second separation zone 222.

The second separation zone 222 is maintained at a temperature level higher than the temperature level in the first separation zone 218 and a pressure level substantially no greater than the pressure level in the first separation zone 218 to effect a separation of the first light phase therein. Preferably, the temperature level is maintained in the range of from about 410 degrees F. to about 750 degrees F. and the pressure level is maintained in the range of from about 590 psig to about 1500 psig.

The particular temperature and pressure conditions in the second separation zone 222 are selected to provide a differential in the solvent density in the first light phase sufficiently large to cause the first light phase to separate into two fluid-like phases.

The first light phase separates into a second heavy phase comprising insoluble coal products, soluble coal products, and some solvent and a second light phase comprising soluble coal products and solvent.

The second heavy phase is withdrawn from the second separation zone 222 through a conduit 224. At least a portion of the second heavy phase in conduit 224 is withdrawn in a conduit 226 for introduction into a treatment zone 246.

In treatment zone 246, the portion of the second heavy phase is maintained at an elevated temperature for a sufficient length of time to result in partial polymerization of at least a portion of the hydrocarbonaceous material contained therein. The amount of time required to induce partial polymerization depends upon the temperature at which the second heavy phase is maintained. Preferably, the withdrawn portion of the second heavy phase is heated to a temperature above 650 degrees F. and most preferably above 800 degrees F. Typically, a sufficient time is from about 1 to about 30 minutes; however, longer times can be employed. The longer the time in which the hydrocarbonaceous material is maintained at an elevated temperature the greater will be the extent of polymerization.

The polymerization of the hydrocarbonaceous material results in an increase in the molecular weight of at least a portion of the material. The treated second heavy phase then is withdrawn from the treatment zone 246 and introduced into the first mixing zone 214 through a conduit 248. In the first mixing zone the treated second heavy phase is contacted and mixed with entering feed mixture and then is introduced into the first separation zone 218 therewith. The mixture in the first separation zone is separated into a first heavy phase and a first light phase as previously described. The first heavy phase comprises insoluble coal products and some solvent.

The temperature and pressure conditions within the first separation zone 218 are selected to maximize the separation of soluble coal products from the insoluble coal products in the feed. The effect of such maximization results in the carry-over of a small amount of insoluble coal products in the first light phase that is removed in the second separation zone 222 as the second heavy phase. The treatment of the recycled portion of the second heavy phase facilitates the subsequent recovery of soluble coal products therefrom.

Alternatively, the treatment zone 246 can comprise an oxidation zone wherein the separated portion of the second heavy phase is contacted with, for example, air, oxygen and carbon dioxide or other oxidizing gases to effect an oxydehydrogenation or an incorporation of oxygen into at least a portion of the hydrocarbonaceous material. The oxydehydrogenation of the hydrocarbonaceous material results in an increase in the molecular weight of at least a portion of the material commensurate to partial polymerization accomplished by heating. The treatment also can comprise a combination of oxidation and polymerization as long as it results in an increase in the molecular weight of at least a portion of the treated material.

The second light phase is withdrawn through a conduit 232 and introduced into a third separation zone 230.

The third separation zone 230 is maintained at a temperature level higher than the temperature level maintained in the second separation zone 222 and a pressure level substantially no greater than the pressure level of the second separation zone 222 to effect a separation of the second light phase therein. Preferably, the temperature level is maintained in the range of from about 500 degrees F. to about 950 degrees F. and the pressure level is maintained in the range of from about 40 psig to about 1450 psig.

The particular temperature and pressure conditions in the third separation zone 230 are selected to effect the maximum separation of the soluble coal products by providing a differential in the solvent density in the second light phase sufficiently large to cause the second light phase to separate into the two fluid-like phases.

The second light phase separates into a third light phase comprising solvent and a third heavy phase comprising soluble coal products.

The third light phase is withdrawn from the third separation zone 230 through a conduit 236 for recycle to the mixing zone to aid in providing the feed mixture.

The third heavy phase is withdrawn from the third separation zone 230 through a conduit 234 for recovery.

Figure 4:
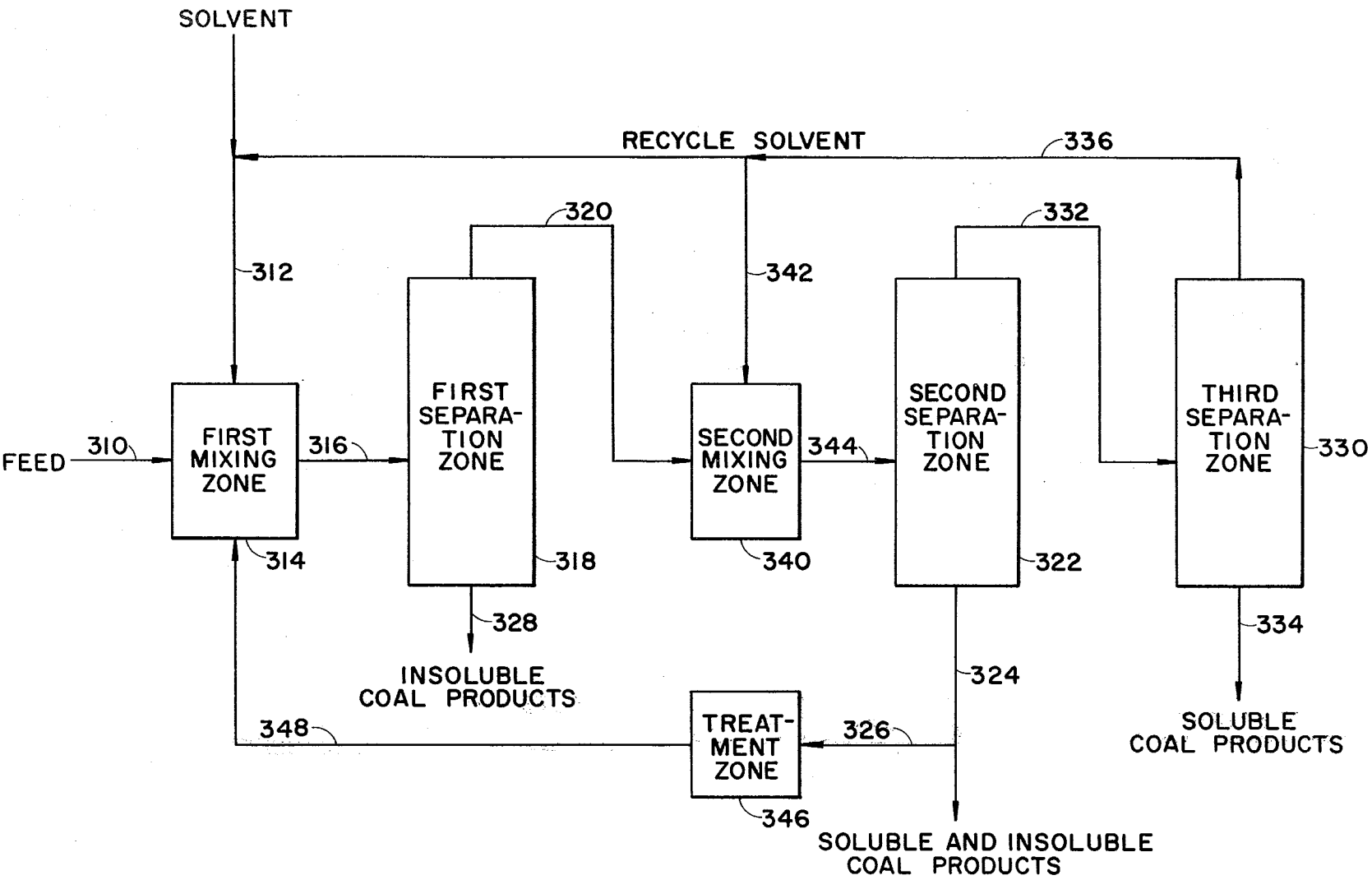
FIG. 4 is a diagrammatic illustration of the process of FIG. 2 incorporating a treatment zone in the second havey phase recycle conduit.

Turning now to FIG. 4, still yet another embodiment of the present invention is illustrated.

The feed flowing in a conduit 310 enters a first mixing zone 314 to contact and mix with a solvent entering the first mixing zone 314 through a conduit 312 to provide a feed mixture. In this embodiment, the ratio of solvent to feed present in the feed mixture is from about 1:1 to below about 2:1, by weight. The feed mixture is discharged from the mixing zone 314 through a conduit 316 to enter a first separation zone 318.

The first separation zone 318 is maintained at a temperature level in the range of from about 400 degrees F. to about 700 degrees F. and a pressure level in the range of from about 600 psig to about 1500 psig to effect a separation of the feed mixture.

In the first separation zone 318, the feed mixture separates into a first heavy phase and a first light phase comprising soluble coal products, insoluble coal products and solvent. The first light phase is withdrawn from the first separation zone 318 through a conduit 320 and introduced into a second mixing zone 340.

In the second mixing zone 340, the first light phase is contacted by and mixed with additional solvent entering via a conduit 342 to provide a ratio of solvent to feed of from about 2:1 to about 10:1, by weight. The mixture then is discharged from the second mixing zone 340 through a conduit 344 to enter a second separation zone 322.

The second separation zone 322 is maintained at a temperature level higher than the temperature level in the first separation zone 318 and a pressure level substantially no greater than the pressure level in the first separation zone 318 to effect a separation of the mixture. Preferably, the temperature level is maintained in the range of from about 410 degrees F. to about 750 degrees F. and the pressure level is maintained in the range of from about 590 psig to about 1500 psig.

The particular temperature and pressure conditions in the second separation zone 322 are selected to provide a differential in the solvent density in the first light phase sufficiently large to cause the first light phase to separate into two fluid-like phases.

In the second separation zone 322, the mixture separates into a second heavy phase comprising insoluble coal products, some soluble coal products and some solvent and a second light phase comprising soluble coal products and solvent. The second heavy phase is withdrawn from the second separation zone 322 through a conduit 324. At least a portion of the second heavy phase flowing in conduit 324 is withdrawn in a conduit 326 and introduced into a treatment zone 346. The treatment zone 346 can comprise a temperature treatment resulting in partial polymerization of the hydrocarbonaceous material or an oxidation treatment resulting in either oxydehydrogenation or incorporation of oxygen into the material or a combination thereof to increase the molecular weight of at least a portion of the material, as previously described.

The treated portion of the second heavy phase is withdrawn from the treatment zone 346 via a conduit 348 and introduced into the first mixing zone 314. In the first mixing zone 314, the treated material contacts and mixes with the feed mixture contained therein and is discharged therewith via conduit 316 to enter the first separation zone 318.

In the first separation zone 318 the mixture is separated into the first heavy phase and the first light phase as previously described. The first heavy phase is withdrawn from the first separation zone 318 through a conduit 328.

The second light phase is withdrawn from the second separation zone through a conduit 332 and introduced into a third separation zone 330. The third separation zone 330 is maintained at a temperature level higher than the temperature level maintained in the second separation zone 322 and a pressure level substantially no greater than the pressure level of the second separation zone 322 to effect a separation of the second light phases therein. Further, the temperature level is maintained in the range of from about 500 degrees F. to about 950 degrees F. The pressure level is in the range of from about 40 psig to about 1450 psig.

The particular temperature and pressure conditions in the third separation zone 330 are selected to effect the maximum separation of the soluble coal products by providing a differential in the solvent density in the second light phase sufficiently large to cause the second light phase to separate into two fluid-like phases.

The second light phase separates into a third light phase comprising solvent and a third heavy phase comprising soluble coal products. The third heavy phase is withdrawn from the third separation zone 330 through a conduit 334. The third light phase is withdrawn from the third separation zone 330 via a conduit 336. The conduit 336 connects with conduits 324 and 312 for recycle of the third light phase comprising solvent to the second mixing zone 340 and first mixing zone 314 respectively.

For the purpose of illustrating the present invention, and not by way of limitation, feed mixtures are prepared by mixing coal liquefaction products with a solvent (comprising benzene) in a ratio of about one part by weight of liquefaction products to about 4 parts by weight of benzene at a pressure level in the range of from about 600 psig to about 1500 psig and at a temperature level in the range of from about 400 degrees F. to about 700 degrees F. The coal liquefaction products were analyzed and found to have the analyses set forth in Table I below.

TABLE I

| | |
|---|---|
| Specific Gravity | |
| 60/60 | 1.34 |
| Proximate Analyses | |
| % Loss at 105° C. | 0.4 |
| % Volatile Matter | 44.7 |
| % Fixed Carbon | 41.5 |
| % Ash | 13.4 |
| Ultimate Analyses | |
| % Carbon | 74.3 |
| % Hydrogen | 5.3 |
| % Nitrogen | 1.5 |

TABLE I-continued

| | |
|---|---|
| % Sulfur | 2.0 |
| % Oxygen (diff.) | 3.5 |
| Sulfur distribution: | |
| $SO_2$ | < 0.1 |
| Pyrite | < 0.1 |
| Pyrrhotite | 1.81 |
| Organic | 0.19 |

The prepared feed mixtures then are utilized in various test runs to demonstrate the effectiveness of the present invention. In each of these test runs, the temperature level in the first separation zone apparatus is about 530 degrees F. and the pressure level is about 800 psig; the temperature level in the second separation zone apparatus is about 550 degrees F. and the pressure level is about 780 psig.

The results of such test runs is described in greater detail in the following Examples.

EXAMPLE I

Two runs are set forth to illustrate the present invention. Specifically, one run is made without recycle of a portion of the second heavy phase. In the second run, a portion of the second heavy phase is recycled in the apparatus as illustrated in FIG. 1.

In each instance, portions of the second light phase are withdrawn periodically through the conduit 32 and then are treated to recover the soluble coal products therefrom. It is determined that soluble coal products obtained from the first run, without recycle of the second heavy phase, contain from about 0.1 percent to about 0.15 percent by weight of ash. By way of contrast, the soluble coal products recovered from the run in which a portion of the second heavy fraction is recycled through conduit 26 to mixing zone 14 are recovered in an improved yield over that obtained from the first run with a comparable ash content.

EXAMPLE II

Two runs are conducted: one run is made without recycle of a treated portion of the second heavy phase; and in the second run, a portion of the second heavy phase is treated in treating zone 246 and recycled to the mixing zone 214 through conduit 248 as illustrated in FIG. 3.

In each instance, portions of the second light phase are withdrawn periodically through the conduit 232 and then are treated to recovered the soluble coal products therefrom. It is determined that soluble coal products obtained from the first run, without the recycle of the treated portion of the second heavy phase, contain from about 0.1 percent to about 0.15 percent by weight of ash. By way of contrast, the soluble coal products recovered from the run in which a treated portion of the second heavy phase is recycled to mixing zone 214 are recovered in an improved yield over that obtained from the first run with a comparable ash content.

To further illustrate the present invention, new feed mixtures are prepared by mixing coal liquefaction products with benzene in a ratio of about one part by weight of liquefaction products to about 1.5 parts by weight of benzene at a pressure level in the range of from about 600 psig to about 1500 psig and at a temperature level in the range of from about 400 degrees F. to about 700 degrees F. The analyses of the coal liquefaction products are as set forth in Table I.

The new prepared feed mixtures then are utilized in various test runs. In each of the test runs, the temperature level in the first separation zone apparatus is about 530 degrees F. and the pressure level is about 800 psig; sufficient solvent is introduced into the second mixing zone to provide a ratio of feed to solvent of about 1:4, by weight; and the temperature level in the second separation zone apparatus is about 550 degrees F. and the pressure level is about 780 psig.

EXAMPLE III

Two runs are conducted: one run is made without the recycle of a portion of the second heavy phase; and in the second run, a portion of the second heavy phase is recycled via conduit 126 in the apparatus illustrated in FIG. 2.

In each instance, portions of the second light phase are withdrawn periodically through the conduit 132 and then are treated to recover the soluble coal products therefrom. It is determined that soluble coal products obtained from the first run, without recycle of the second heavy phase, contain from about 0.1 percent to about 0.15 percent by weight of ash. By way of contrast, the soluble coal products recovered from the run in which a portion of the second heavy phase is recycled through conduit 126 to mixing zone 114 are recovered in an improved yield over that obtained from the first run with a comparable ash content.

EXAMPLE IV

Two runs are conducted: one run is without recycle of a treated portion of the second heavy phase; and in the second run, mix with a treated portion of the second heavy phase is recycled to the mixing zone 314 in the apparatus as illustrated in FIG. 4.

In each instance, portions of the second light phase are withdrawn periodically through the conduit 332 and then are treated to recover the soluble coal products therefrom. It is determined that soluble coal products obtained from the first run, without recycle of a treated portion of the second heavy phase, contain from about 0.1 percent to about 0.15 percent by weight of ash. By way of contrast, the soluble coal products recovered from the second run in which a treated portion of the second heavy phase is recycled to mixing zone 314 through conduit 348 are recovered in an improved yield over that obtained from the first run with a comparable ash content.

While the present invention has been described with respect to that which at present is considered to be the preferred embodiments thereof, it is to be understood that changes or modifications can be made in the process or apparatus without departing from the spirit or scope of the invention as defined by the following claims.

What is claimed is:

1. A coal liquefaction product deashing process comprising:

providing a coal liquefaction product feed comprising soluble coal products and insoluble coal products;

providing a solvent consisting essentially of at least one substance having a critical temperature below 800 degrees F. selected from the group consisting of aromatic hydrocarbons having a single benzene nucleus and normal boiling points below about 310 degrees F., cycloparaffin hydrocarbons having normal boiling points below about 310 degrees F., open chain mono-olefin hydrocarbons having normal boiling points below about 310 degrees F., open chain saturated hydrocarbons having normal boiling points below about 310 degrees F., mono-, di, and tri-open chain amines containing from about 2–8 carbon atoms, carbocyclic amines having a monocyclic structure containing from about 6–9 carbon atoms, heterocyclic amines containing from about 5–9 carbon atoms, and phenols containing from about 6–9 carbon atoms and their homologs;

admixing said feed with said solvent in a mixing zone to provide a feed mixture;

introducing said feed mixture into a first separation zone maintained at an elevated temperature and pressure;

separating said feed mixture in said first separation zone into a first heavy phase and a first light phase comprising soluble coal products, solvent and some insoluble coal products;

withdrawing said first light phase from said first separation zone;

introducing said withdrawn first light phase into a second separation zone maintained at a temperature level higher than the temperature level in said first separation zone and at an elevated pressure;

separating said first light phase in said second separation zone into a second heavy phase comprising insoluble coal products, soluble coal products and some solvent and a second light phase comprising soluble coal products and solvent as said deashed coal liquefaction product;

withdrawing said second heavy phase from said second separation zone;

recycling at least a portion of said withdrawn second heavy phase to said first separation zone in admixture with said feed mixture to recover soluble coal products therefrom; and withdrawing said first heavy phase from the first separation zone, said first heavy phase having an increased mineral matter content effected through recycle of said portion of the second heavy phase.

2. The process of claim 1 wherein the first separation zone is maintained at an elevated temperature and pressure defined further as:

maintaining said first separation zone at a temperature level in the range of from about 400 degrees F. to about 700 degrees F. and a pressure level in the range of from about 600 psig to about 1500 psig;

and wherein maintaining the second separation zone at a higher temperature level and an elevated pressure is further defined as:

maintaining said second separation zone at a temperature level higher than the temperature level in the first separation zone and in the range of from about 410 degrees F. to about 750 degrees F. and a pressure level in the range of from about 590 psig to about 1500 psig.

3. The process of claim 1 defined further to include the steps of:

withdrawing said second light phase from said second separation zone;

introducing said withdrawn second light phase into a third separation zone;

separating said second light phase in said third separation zone into a third heavy phase comprising the soluble coal products and a third light phase comprising the solvent;

withdrawing said third heavy phase from said third separation zone;

withdrawing said third light phase from said third separation zone; and recycling said withdrawn third light phase to said mixing zone to aid in providing said feed mixture.

4. The process of claim 3 wherein the third separation zone comprises a flash zone.

5. The process of claim 3 defined further to include the step of:

maintaining the third separation zone at a temperature level higher than the temperature level in the second separation zone and in the range of from about 500 degrees F. to about 950 degrees F. and a pressure level in the range of from about 40 psig to about 1450 psig.

6. A coal liquefaction product deashing process comprising:

providing a coal liquefaction product feed comprising soluble coal products and insoluble coal products;

providing a solvent consisting essentially of at least one substance having a critical temperature below 800 degrees F. selected from the group consisting of aromatic hydrocarbons having a single benzene nucleus and normal boiling points below about 310 degrees F., cycloparaffin hydrocarbons having normal boiling points below about 310 degrees F., open chain mono-olefin hydrocarbons having normal boiling points below about 310 degrees F., open chain saturated hydrocarbons having normal boiling points below about 310 degrees F., mono-, di, and tri-open chain amines containing from about 2–8 carbon atoms, carbocyclic amines having a monocyclic structure containing from about 6–9 carbon atoms, heterocyclic amines containing from about 5–9 carbon atoms, and phenols containing from about 6–9 carbon atoms and their homologs;

admixing said feed with said solvent in a mixing zone to provide a feed mixture;

introducing said feed mixture into a first separation zone maintained at an elevated temperature and pressure;

separating said feed mixture in said first separation zone into a first heavy phase and a first light phase comprising soluble coal products, solvent and some insoluble coal products;

withdrawing said first light phase from said first separation zone;

introducing said withdrawn first light phase into a second separation zone maintained at a temperature level higher than the temperature level in the first separation zone and at an elevated pressure;

separating said first light phase in said second separation zone into a second heavy phase comprising insoluble coal products, soluble coal products and some solvent and a second light phase comprising soluble coal products and solvent as said deashed coal liquefaction product;

withdrawing said second heavy phase from said second separation zone;

introducing at least a portion of said withdrawn second heavy phase into a treatment zone;

treating said portion of said withdrawn second heavy phase to effect an increase in the molecular weight of at least a portion of said withdrawn second heavy phase;

withdrawing said treated second heavy phase from said treatment zone;

introducing said treated second heavy phase into said mixing zone to contact and mix with feed and solvent contained therein; and withdrawing said first heavy phase from the first separation zone, said first heavy phase having an increased mineral matter content effected through recycle of said portion of the second heavy phase.

7. The process of claim 6 wherein the treatment zone comprises a temperature treatment zone and treating said portion of the withdrawn second heavy phase is defined further as:

maintaining the portion of the withdrawn second heavy phase at an elevated temperature for a sufficient length of time to effect a partial polymerization of at least a portion thereof to effect an increase in the molecular weight of at least a portion of the withdrawn second heavy phase.

8. The process of claim 7 wherein the elevated temperature is defined further as a temperature above 800 degrees F.

9. The process of claim 6 wherein the treatment zone comprises an oxidation treatment zone and treating said portion of the withdrawn second heavy phase is defined further as:

contacting the portion of the withdrawn second heavy phase with an oxidizing gas to effect an increase in the molecular weight of at least a portion of said material.

10. The process of claim 6 wherein the treatment zone comprises a combination of a temperature treatment zone and an oxidation zone and treating comprises a combination of temperature treatment and oxidation.

11. A coal liquefaction product deashing process comprising:

providing a coal liquefaction product feed comprising soluble coal products and insoluble coal products;

providing a solvent consisting essentially of at least one substance having a critican temperature below 800 degrees F. selected from the group consisting of aromatic hydrocarbons having a single benzene nucleus and normal boiling points below about 310 degrees F., cycloparaffin hydrocarbons having normal boiling points below about 310 degrees F., open chain mono-olefin hydrocarbons having normal boiling points below about 310 degrees F., open chain saturated hydrocarbons having normal boiling points below about 310 degrees F., mono-, di, and tri-open chain amines containing from about 2–8 carbon atoms, carbocyclic amines having a mono- cyclic structure containing from about 6–9 carbon atoms, heterocyclic amines containing from about 5–9 carbon atoms, and phenols containing from about 6–9 carbon atoms and their homologs;

admixing said feed with said solvent in a first mixing zone to provide a feed mixture;

introducing said feed mixture into a first separation zone maintained at an elevated temperature and pressure;

separating said feed mixture in said first separation zone into a first heavy phase and a first light phase comprising soluble coal products, solvent and some insoluble coal products;

withdrawing said first light phase from said first separation zone;

introducing said withdrawn first light phase into a second mixing zone;

mixing said withdrawn first light phase with an additional portion of solvent to form a mixture;

introducing said mixture from said second mixing zone into a second separation zone;

separating said mixture in said second separation zone into a second heavy phase comprising insoluble coal products, soluble coal products and some solvent and a second light phase comprising soluble coal products and solvent as said deashed coal liquefaction product;

withdrawing said second heavy phase from said second separation zone;

recycling at least a portion of said withdrawn second heavy phase to said first separation zone in admixture with said feed mixture to recover soluble coal products therefrom; and withdrawing said first heavy phase from said first separation zone, said first heavy phase having an increased mineral matter content effected through recycle of said portion of the second heavy phase.

12. The process of claim 11 wherein the first separation zone is maintained at an elevated temperature and pressure defined further as:

maintaining said first separation zone at a temperature level in a range of from about 400 degrees F. to about 700 degrees F. and a pressure level in a range of from about 600 psig to about 1500 psig;

and wherein maintaining the second separation zone at a higher temperature level and an elevated pressure is further defined as:

maintaining said second separation zone at a temperature level higher than the temperature level in the first separation zone and in a range of from about 410 degrees F. to about 750 degrees F. and a pressure level in a range of from about 590 psig to about 1500 psig.

13. The process of claim 11 defined further to include the steps of:

withdrawing said second light phase from said second separation zone;

introducing said withdrawn second light phase into a third separation zone;

separating said second light phase in said third separation zone into a third heavy phase comprising the soluble coal products and a third light phase comprising the solvent;

withdrawing said third heavy phase from said third separation zone;

withdrawing said third light phase from said third separation zone; and recycling said withdrawn third light phase to said first mixing zone and said second mixing zone.

14. The process of claim 13 wherein the third separation zone comprises a flash zone.

15. The process of claim 13 defined further to include the step of:

maintaining said third separation zone at a temperature level higher than the temperature level in the second separation zone and in a range of from about 500 degrees F. to about 950 degrees F. and a pressure level in a range of from about 40 psig to about 1450 psig.

16. A coal liquefaction product deashing process comprising:

providing a coal liquefaction product feed comprising soluble coal products and insoluble coal products;

providing a solvent consisting essentially of at least one substance having a critican temperature below 800 degrees F. selected from the group consisting of aromatic hydrocarbons having a single benzene nucleus and normal boiling points below about 310 degrees F., cycloparaffin hydrocarbons having normal boiling points below about 310 degrees F., open chain mono-olefin hydrocarbons having normal boiling points below about 310 degrees F., open chain saturated hydrocarbons having normal boiling points below about 310 degrees F., mono-, di, and tri-open chain amines containing from about 2–8 carbon atoms, carbocyclic amines having a mono-cyclic structure containing from about 6–9 carbon atoms, heterocyclic amines containing from about 5–9 carbon atoms, and phenols containing from about 6–9 carbon atoms and their homologs;

admixing said feed with said solvent in a first mixing zone to provide a feed mixture;

introducing said feed mixture into a first separation zone maintained at an elevated temperature and pressure;

separating said feed mixture in said first separation zone into a first heavy phase and a first light phase comprising soluble coal products, solvent and some insoluble coal products;

withdrawing said first light phase from said first separation zone;

introducing said withdrawn first light phase into a second mixing zone;

mixing said withdrawn first light phase with an additional portion of solvent to form a mixture;

introducing said mixture from said second mixing zone into a second separation zone;

separating said mixture in said second separation zone into a second heavy phase comprising insoluble coal products, soluble coal products and some solvent and a second light phase comprising soluble coal products and solvent as said deashed coal liquefaction product;

withdrawing said second heavy phase from said second separation zone;

introducing at least a portion of said withdrawn second heavy phase into a treatment zone;

treating said portion of said withdrawn second heavy phase to effect an increase in the molecular weight of at least a portion of said withdrawn second heavy phase;

withdrawing said treated second heavy phase from said treatment zone;

introducing said treated second heavy phase into said first mixing zone to contact and mix with said feed and solvent contained there; and withdrawing said first heavy phase from said first separation zone, said first heavy phase having an increased mineral matter content effected through recycle of said portion of the second heavy phase.

17. The process of claim 16 wherein the treatment zone comprises a temperature treatment zone and treating said portion of the withdrawn second heavy phase is defined further as:

maintaining said portion of said withdrawn second heavy phase at an elevated temperature for a sufficient length of time to effect a partial polymerization of at least a portion thereof to effect an increase in the molecular weight of at least a portion of said withdrawn the second heavy phase.

18. The process of claim 17 wherein the elevated temperature is defined further as a temperature above 800 degrees F.

19. The process of claim 16 wherein the treatment zone comprises an oxidation treatment zone and treating said portion of the withdrawn second heavy phase is defined further as:

contacting said portion of said withdrawn second heavy phase with an oxidizing gas to effect an increase in the molecular weight of at least a portion of said material.

20. The process of claim 16 wherein said treatment zone comprising a combination of a temperture treatment zone and an oxidation zone and treating comprises a combination of temperature treatment and oxidation.

* * * * *